United States Patent [19]

Randolph

[11] 4,108,063

[45] Aug. 22, 1978

[54] HYDRAULIC BAGGING PRESS

[76] Inventor: Arthur J. Randolph, 4711 Sonoma Hwy., Santa Rosa, Calif. 95405

[21] Appl. No.: 834,714

[22] Filed: Sep. 19, 1977

[51] Int. Cl.[2] ..... B30B 15/30

[52] U.S. Cl. ..... 100/53; 100/91; 100/215; 100/218; 100/232; 100/244; 100/251; 100/257; 53/124 B

[58] Field of Search ..... 100/90, 91, 257, 245, 100/295, 53, 232, 251, 42, 215, 218, 244; 53/124 B

[56] References Cited

U.S. PATENT DOCUMENTS

| | | | |
|---|---|---|---|
| 313,960 | 3/1885 | Sherman | 100/91 |
| 2,151,855 | 3/1939 | Kobold | 100/232 X |
| 2,984,172 | 5/1961 | Roberts | 100/218 X |
| 3,117,513 | 1/1964 | Burnett | 100/215 |
| 3,382,643 | 5/1968 | Hullhorst | 100/90 X |
| 3,408,927 | 11/1968 | Willock | 100/232 X |

FOREIGN PATENT DOCUMENTS

| | | | |
|---|---|---|---|
| 1,273,979 | 9/1961 | France | 100/244 |
| 2,237,430 | 2/1975 | France | 100/218 |
| 6,706,049 | 12/1967 | Netherlands | 100/218 |

*Primary Examiner*—Billy J. Wilhite
*Attorney, Agent, or Firm*—Edward B. Gregg; Alvin E. Hendricson

[57] ABSTRACT

A machine feeds material such as shredded or ground paper, cellulose fiber, peat moss, or the like, into a vertical chamber having a ram forcing the material into a communicating chamber adapted to retain a bag over an open end thereof and having a ram or pressure plate moveable longitudinally thereof for compressing the material in the chamber. The rams are perforated, with the rear thereof being evacuated to dispose of dust or the like, and a piston operated back-up plate is mounted on a track for controlled movement relative to the open ended chamber for holding a bag end during compression of material and removal of loaded bags.

8 Claims, 12 Drawing Figures

-3-
-2-
36
43
42
37
38
41
44
23
59
68
58
52
51
108
32
72
22
93
94
92
91
26
21
73
71
39
67
54
31
81
87
27
33
24
76
78

73
54
61
58
56
52
68
59
51
67
53
62
66
63
57
114
39
37
108
33
72
107
98
97
92
99
91
106
-7-
-4-
-5-
-6-
32
26
21
71
86
81
84
77
79
76
82
87
24

FIG. 4
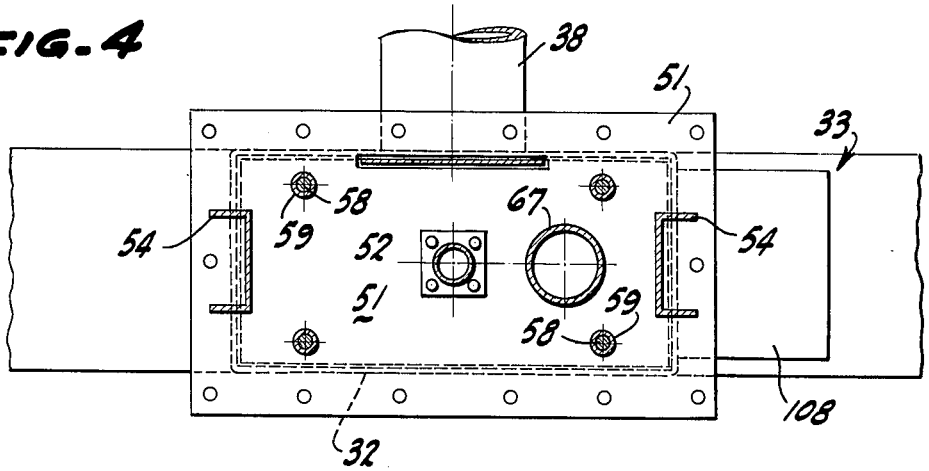
FIG. 5
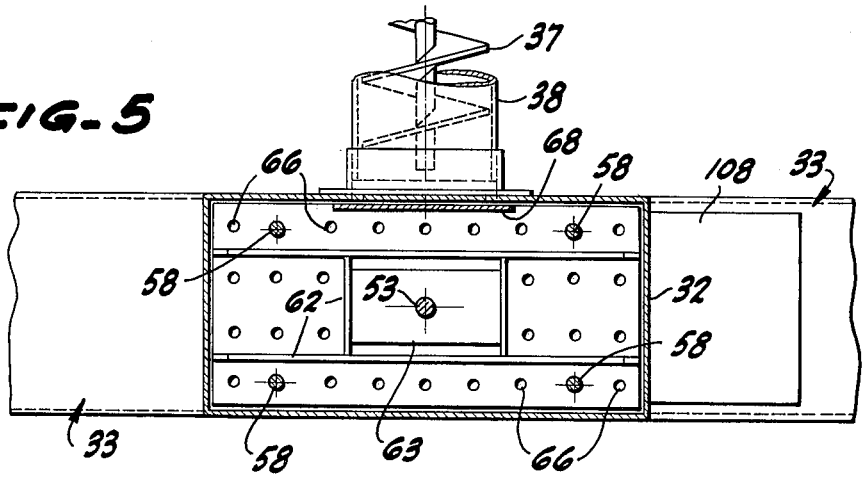
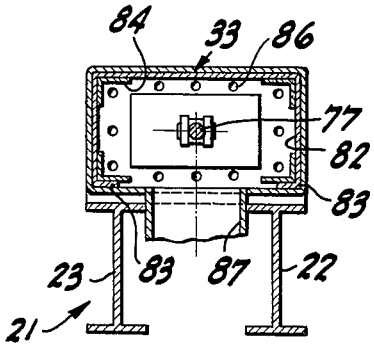
FIG. 6
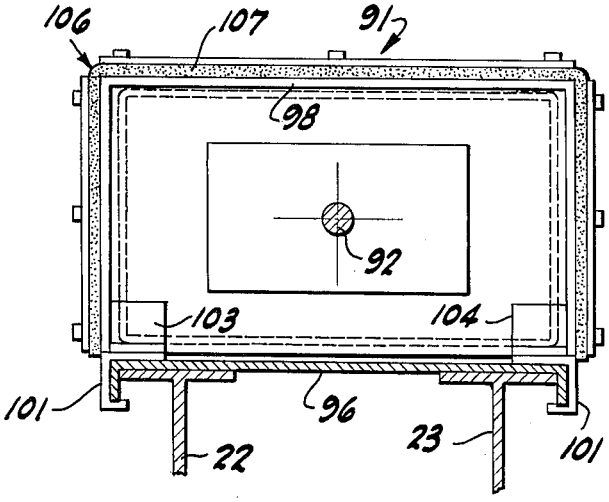
FIG. 7

94
93
92
26
91
21
73
72
33
108
112
51
67
52
114
39
68
81
57
111
32
113
87
82
24
76
78

94
93
92
91
73
33
111
108
112
66
52
51
68
53
39
57
81
86
113
87
82
76
78

HYDRAULIC BAGGING PRESS

BACKGROUND

Many materials that are shredded, ground, or otherwise divided into pieces, fibers, strips, or the like, require compression, in order to force a substantial quantity thereof into shipping containers, for example. The present invention is herein disclosed with regard to bagging shredded or ground paper, fiber, or the like, and such material includes a large amount of finely divided fiber dust, so that handling thereof rapidly pollutes the atmosphere, particularly in the vicinity of handling equipment.

Normally, bagging presses employed to compress shredded paper, fibers, or the like, into containers suffer from difficulties by entrapping air in the container and in evolving and discharging large volumes of dust or small particles. Additionally, the very nature of shredded paper or the like, complicates handling including movement thereof and placement in a container, particularly, in high speed operations.

SUMMARY

The present invention employs a rotatable feed screw extending from a chamber into a vertically disposed closed chamber communicating with the top of a horizontal chamber. A vertically moveable hydraulic ram is slidably disposed within the vertical chamber with a side plate moveable with the vertical ram to close off the feed opening during cylinder actuation to force material downward into the horizontal chamber. A horizontal hydraulic or pneumatic compression ram is controllably moved in the horizontal chamber after displacement of the vertical ram for compressing material in the press and then forcing the material into a bag or the like, removably mounted over the open end of the horizontal chamber. The horizontal compression ram carries a slide plate or shutter for closing the opening between the vertical closed chamber and the horizontal chamber when the horizontal ram is moved to compress material. A back-up ram is mounted on a horizontal track and is operated by a hydraulic or pneumatic cylinder to hold the closed end of a bag across the open end of the horizontal chamber, so that material is compressed therein by the horizontal ram. As soon as the slide plate or shutter of the horizontal ram closes the opening between the vertical and horizontal chambers, the vertical ram is raised to uncover the feed screw opening in the vertical chamber. The feed screw is then started to feed material into the press while the horizontal ram is compressing material and subsequently extruding same into a bag. After compression of material, the back-up ram and horizontal ram are simultaneously operated to force compressed material into the bag as it moves off of the open-ended horizontal chamber.

Both the vertical ram and horizontal compression ram are perforated to allow air flow therethrough and the back side of each ram is connected to exhaust means for removing air and accompanying dust through a cyclone back into the hopper or for filtering before discharge. As the material to be bagged is compressed, a substantial amount of air is forced through the perforated rams and much dust or finely divided particles are entrained in this air. The present invention removes this pollutant from the vicinity of the equipment and settles this dust as by passage of the discharged air through a cyclone or through filtering means.

The present invention provides for sequencing the operation of the three hydraulic cylinders and the rotatable feed screw, as generally identified above, and this may be accomplished by conventional means either automatically or semi-automatically. A substantially continuous and quite rapid bagging operation is accomplished by the present invention to thus provide an economically advantageous method and system.

DESCRIPTION OF FIGURES

The present invention is illustrated with respect to a preferred embodiment thereof in the accompanying drawings wherein:

FIG. 4 is a horizontal transverse sectional view of the press taken in the plane 4—4 of FIG. 3;

FIG. 5 is a horizontal transverse sectional view through the vertical ram structure of the press taken in the plane 5—5 of FIG. 3;

FIG. 6 is a transverse sectional view through the horizontal ram structure of the press taken in the plane 6—6 of FIG. 3;

FIG. 7 is an enlarged transverse sectional view showing the pressure back-up ram and taken in the plane 7—7 of FIG. 3.

DESCRIPTION OF PREFERRED EMBODIMENT

Figures 1, 2:
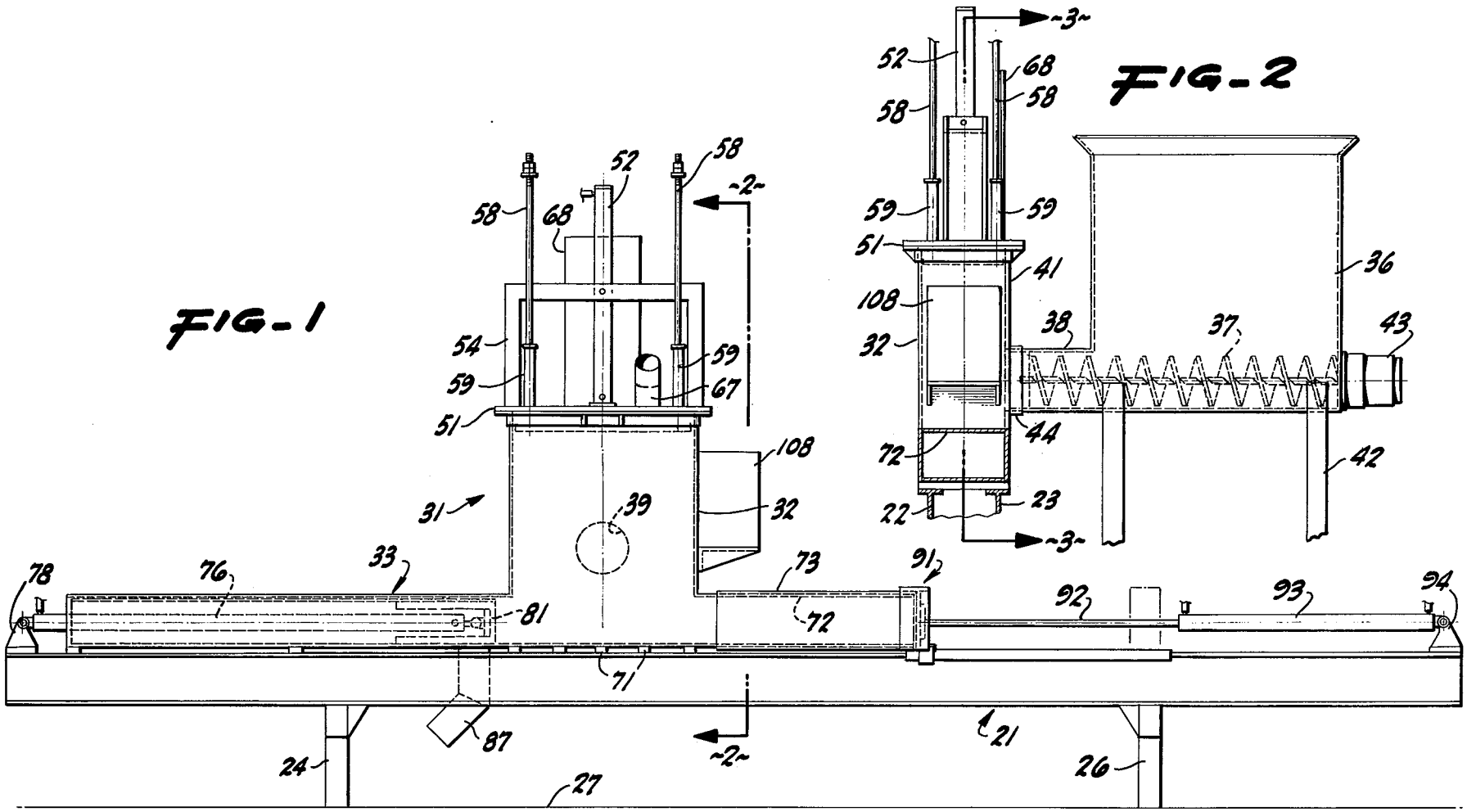
FIG. 1 is a side elevational view of the press of the present invention.
FIG. 2 is a partial vertical transverse sectional view taken in the plane 2—2 of FIG. 1 and showing the screw feed means.

The present invention is normally provided as a substantial physical structure having an elongated horizontal bed 21 which may, for example, be formed of a parallel-spaced vertically disposed I-beams 22 and 23, having appropriate cross pieces and end pieces to comprise a rigid physical structure. Appropriate support means, such as legs 24 and 26 may be welded or otherwise attached to the underside of the frame 21 for supporting the frame upon a concrete floor or the like 27. Upon the frame 21, there is mounted a vertical ram structure 31, including an internal or closed rectangular chamber 32 communicating with the upper side of an elongated horizontal chamber 33. Extending from one lateral side of the frame 21 in communication with the vertical closed chamber 32, there is provided an open chamber 36 with a feed screw 37 extending laterally across the bottom thereof and through a short connecting pipe 38 into communication with the vertical closed chamber 32 at an opening 39 in the back wall 41 thereof. The outer or open chamber 36 may be supported upon appropriate legs or support means 42 and the feed screw 37 is driven for rotation by a motor 43 mounted on the back side of the chamber 36 and connected to the screw 37. This outer chamber 36 and feed screw 37 may be removably engaged with one vertical ram structure 31 as by means of a short stub pipe 44 extending from the back wall 41 of the ram chamber 32 about the opening 39 and fitting about the lateral pipe 38 of the external chamber 36. It will be appreciated that loose material, such as shredded paper or the like, may be dumped into the open top of the chamber 36 and with the feed screw 37 rotating, such material will be fed through the opening 39 into the vertical ram chamber 32. It is noted that the opening 39 in the vertical chamber 32 is located near the bottom thereof, so that the material fed into this chamber 32 is pushed upwardly in the chamber. This manner of material causes some natural compression of the fibers, shreds or the like of material and somewhat reduces the volume of air entrained therein.

Figures 3, 3A:
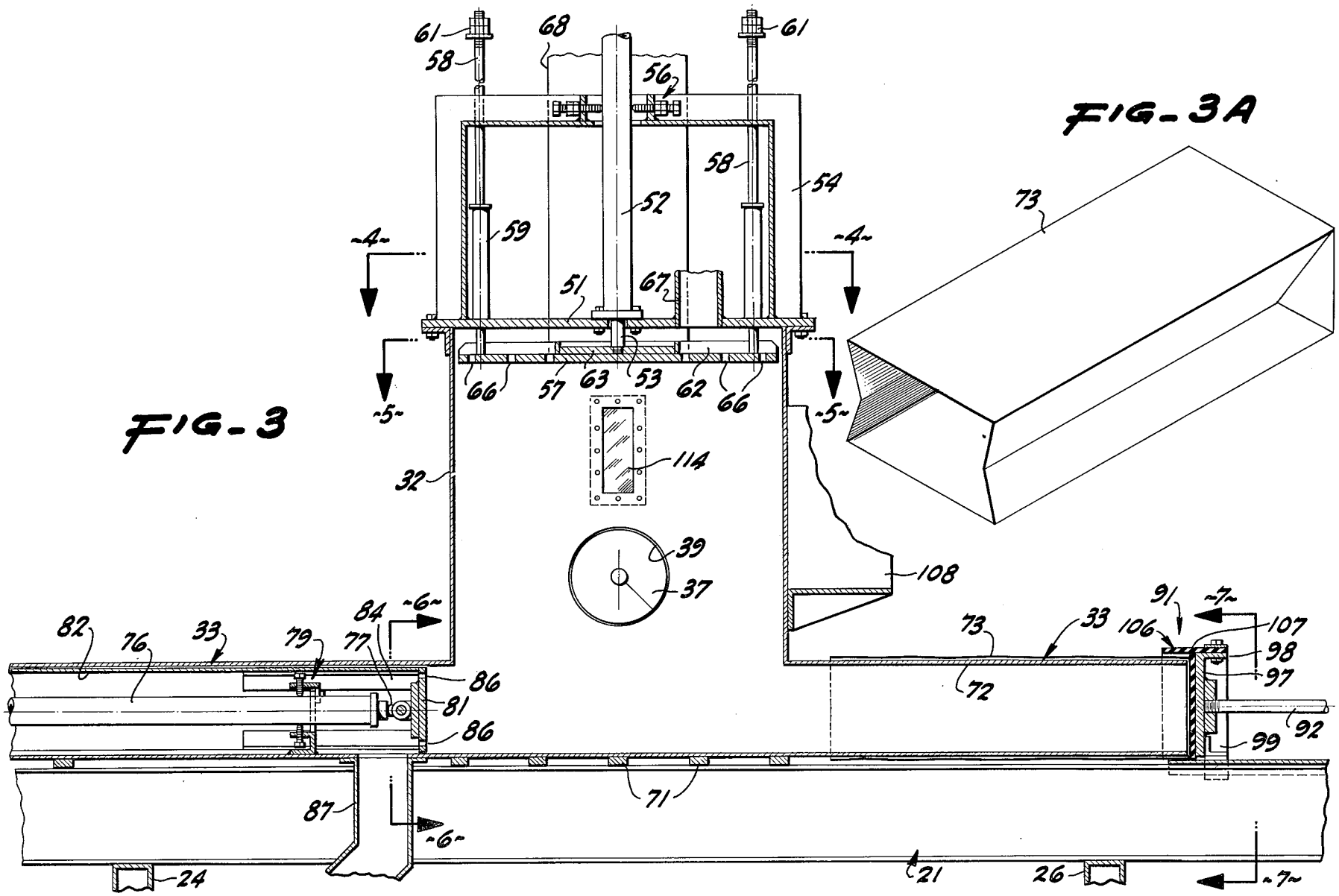
FIG. 3 is a vertical central sectional view of the press taken in the plane 3—3 of FIG. 2.
FIG. 3A is a perspective view of a bag that may be employed with the press of this invention.

The vertical ram assembly 31, as illustrated in FIGS. 3, 4, and 5 will be seen to include a transverse cylinder support plate 51 bolted or otherwise secured across the top of the vertical chamber 32 and mounting a pneumatic or hydraulic cylinder 52 thereon, with the piston rod 53 thereof extending through a central opening in the plate 51. Inasmuch as the hydraulic, or possible pneumatic, cylinder 52 must be quite long in order to extend the piston rod 53 substantially therefrom, there is provided as a part of the structure hereof an upright inverted U-shape cylinder-stabilizing frame 54 formed, for example, of channels appropriately welded together and having a central opening through the upper cross piece for extension of the hydraulic cylinder 52 therethrough. Threaded aligning and stabilizing means 56 are mounted on the upper cross piece of the frame 54 for engaging the cylinder 52. A vertical ram or compression plate 57 is secured to the piston rod 53 below the upper plate 51 and means are provided for ensuring true vertical travel of the ram 57 by the provision of guide rods 58 secured to the back side of the ram 57 and extending vertically upward therefrom through the upper plate 51 and through elongated hollow cylinders 59 welded or otherwise secured to the upper side of the top plate 51. There are preferably provided four guide rods 58 and the upper end of each is preferably threaded, as illustrated with adjusting nuts 61 being threaded thereon for precisely setting the maximum extension or stroke of the ram 57 so that the ram will stop in alignment across the opening between the vertical and horizontal chambers.

The vertical ram 57 is adapted to be reciprocated within the ram chamber 32, in order to force shredded paper, fibers, or the like, downward into the horizontal chamber 33. The vertical chamber 32 has a rectangular cross section, as illustrated, for example, in FIG. 5 and the ram 57 is dimensioned to fit this internal cross section. In view of the fact that the ram 57 experiences substantial pressure in forcing shredded paper or the like downward in a vertical chamber, there are preferably provided stiffening plates 62 on the back or upper side of the ram, and also the piston rod 53 is preferably threaded into a flat plate 63 on the upper side of the ram.

As a further portion of the vertical ram structure 31, provision is made for removing air from the shredded paper or the like compressed by the ram. To this end, the ram 57 is provided with perforations 66 therethrough, and the upper plate 51 of the chamber 32 is pierced by an exhaust conduit 67 which is adapted to be connected to an exhaust fan 112 or the like, for exhausting air and entrained particles which pass through the perforations 66 in the ram 57. As a further portion of the vertical ram structure 31 there is provided a vertically disposed side plate 68 which is secured to the ram 57 in sliding relationship with the back wall 41 of the chamber 32 and which extends vertically upward through an opening or slot 69 in the top plate 51. This back plate 68 will thus be seen to be moveable with the ram 57, so as to close off the opening 39 to the chamber 32 as the ram 57 passes this opening. It will be appreciated that the side plate or gate 68 is vertically elongated so as to ensure closing of the opening 39 as the ram passes this opening and this plate or gate 68 is sufficiently elongated that the upper end thereof remains in the opening 69 in the upper plate 51 at the lower-most position of the ram, in order to maintain this plate or gate tightly against the back wall 41.

Immediately below the vertical ram structure 31, there is disposed the horizontal chamber 33 which is formed with a rectangular cross section, as illustrated in FIG. 6, for example and having a width equal to the width of the vertical chamber 32 which communicates therewith, as shown in FIG. 3. The horizontal chamber 33 rests upon cross pieces 71 on the frame 21 and includes an elongated open ended compression chamber 72 cantilevered laterally outward of the vertical chamber 32 above the frame 21 for receiving a bag 73 adapted to be slid over this open-ended portion 72. The horizontal chamber 33 also extends laterally from the other side of the chamber 32 and encases a horizontal hydraulic or pneumatic cylinder 76 having a piston rod 77 extending therefrom toward the open-ended compression chamber of the structure. The cylinder 76 extends through the outer end of the chamber 33, and there is pivotally mounted upon a support 78, as illustrated in FIG. 1 of the drawings. Adjacently the head of the cylinder 76, there is provided a piston mount 79, preferably including adjusting means as illustrated, for aligning the hydraulic cylinder 76 within the chamber 33.

Upon the piston rod 77 there is pivotally mounted a hydraulic ram or compression plate 81 which is dimensioned to fit the interior of the chamber 33 and is adapted to be moved therealong by the cylinder 76. This horizontal ram 81 carries a gate or shutter 82 having an inverted U shape in-cross section with the lower edges of the sides turned inwardly to form runners or wear strips 83, as illustrated in FIG. 6. This shutter or gate 82 is connected to the ram 81 for movement therewith, so as to close off the opening between the horizontal chamber 33 and the vertical chamber 32 as the horizontal ram 81 moves to the right in FIG. 3, for example. Connection between the ram 81 and shutter 82 is provided by angle irons 84 welded or otherwise secured to the ram on the back side thereof at the corners and connected interiorly to the shutter 82.

The horizontally operable ram 81 is also perforated, as indicated at 86 in FIG. 6, for example, in order that air may flow through the ram as the ram is forced against shredded or ground paper, fibers, or the like, to compress such material. Behind the horizontal ram 81, there is provided an exhaust duct 87 extending through the floor or a wall of the chamber 33 and extending downwardly between the I-beams 22 and 23 of the frame 21. The exhaust duct 87 is adapted to be connected to an exhaust fan or air pump 113 for withdrawing air from the cylinder 33 behind the ram 81.

As previously described, the open-ended cantilevered compression chamber 72 of the horizontal chamber 33 is adapted to have a bag 73 fitted thereover, as indicated for example in FIG. 3, and the bag is maintained in this position by a back-up plate 91, which is attached as a ram or the like to the outer end of a piston rod 92 of a hydraulic or pneumatic cylinder 93 pivotally mounted at the opposite end, as indicated at 94 upon the frame 21.

The back-up plate 91 is adapted to slide along the top of the frame 21 and in order to facilitate movement of the back-up plate therealong, the frame 21 is provided with a solid bed plate 96 upon the top thereof and extending along the distance to be traversed by the back-up plate. The plate 91 has a rearwardly extending rim 98 along the sides and top thereof and wear members or runners 101 attached to the bottom of the plate 91 and extending over and beneath the lateral edges of the bed plate 96. The back-up plate will thus be seen to be mounted for movement longitudinally of the frame upon the bed plate 96 thereof as a track, and to be prevented from any vertical movement by the runners or the like 101. There is additionally provided a soft rubber guard 106 upon the back-up plate in extension forwardly of the top and sides thereof, in order to propel a hand or the like of an operator away from the open end of the compression chamber 72 when the back-up plate is moved against this open end. This rubber guard 106 may be mounted on the back-up plate by a rearwardly extending upper lip 107 of the guard being bolted to the rim 98 of the plate, as illustrated.

It will be seen that the back-up plate 91 is moveable longitudinally of the frame 21 by the hydraulic cylinder 93. The distance of travel of the back-up plate is somewhat greater than the length of a bag 73, and it is also noted that the bag 73 is somewhat shorter than the length of the compression chamber 72. Control over operation of the back-up plate and of the horizontal and vertical rams may be accomplished manually by operating suitable valving by hand or through an automatic or semi-automatic control means 108 attached to any convenient portion of the press and serving as by cam action to sequentially open and close valves for operating the cylinders of the press. There may also be provided various control and safety features, such as, for example, switching means carried by the back-up plate to deactivate the cylinder thereof and stop travel of the plate at any time the plate or guard thereon engages an object such as the hand of an operator.

A preferred embodiment of the hydraulic bagging press of the present invention has been described above with reference to the illustrations of FIGS. 1 through 7. Conventional structural details have not been described in detail, however, the major operable parts of the press have been identified both with regard to structure and operation. As noted above, the present invention is particularly adapted to the ram filling of the bags with ground paper, for example, but at the same time, preventing discharge of a large volume of dust particles or the like into the atmosphere about the press. The filling of successive bags is accomplished with the present invention by proper sequencing of operations as described below.

Figure 8:
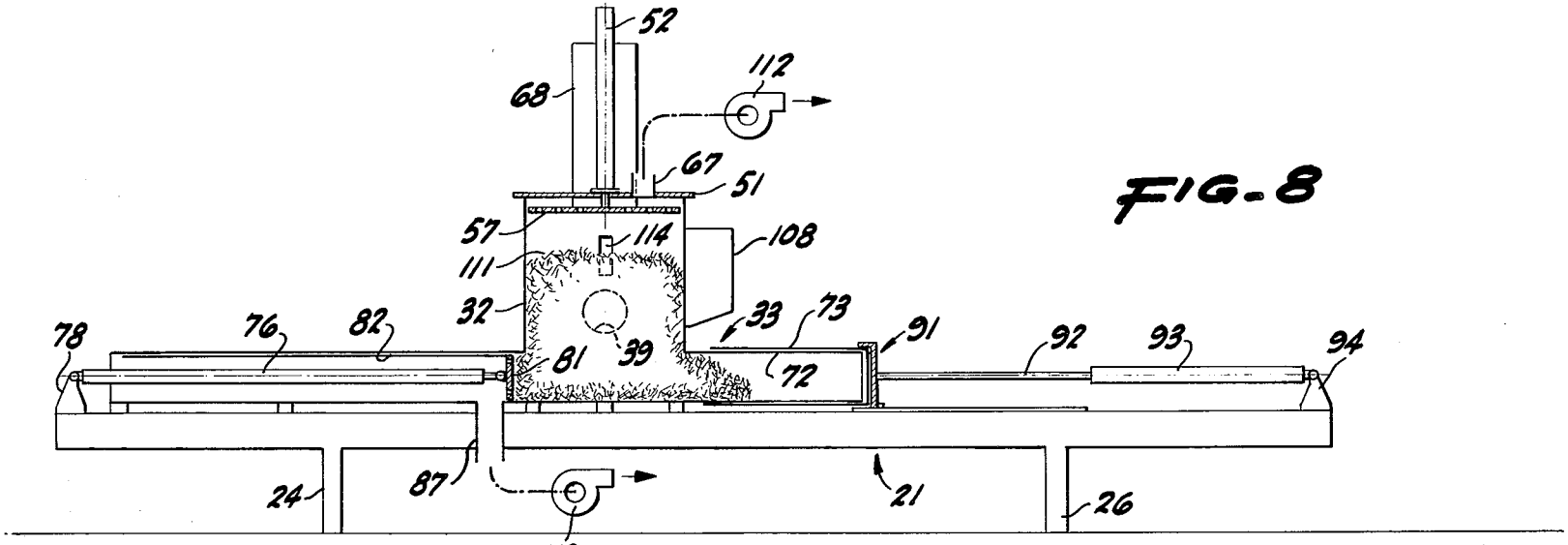
FIGS. 8, 9, 10 and 11 are schematic representations of the invention at successive stages of operation.

Referring now to FIGS. 8 through 11, there will be seen to be schematically illustrated the present invention in successive stages of operation. It is particularly noted that the illustrations of these figures only show the elements of the invention in functional relationship and no attempt is made to illustrate details of construction described above. Considering first FIG. 8 of the drawings, it is noted that with the vertical and horizontal rams or pressure plates 57 and 81 retracted, the feed screw feeds material 111, such as shredded or ground paper or the like into the vertical chamber 32 which communicates with the horizontal chamber 33, so that this material then falls into the horizontal chamber to pile up in somewhat of the manner as illustrated in FIG. 8. Exhaust fans or pumps 112 and 113 connected to the ducts 67 and 87 continuously withdraw air from the interior of the press behind the rams. It will be appreciated that a bag 73 is placed over the open end of the compression chamber 72 and the back-up plate 91 is moved by the hydraulic cylinder 93 into engagement with the bottom of the bag across the open end of the chamber 72 to seal the bag about the open end of the chamber 72.

Figure 9:
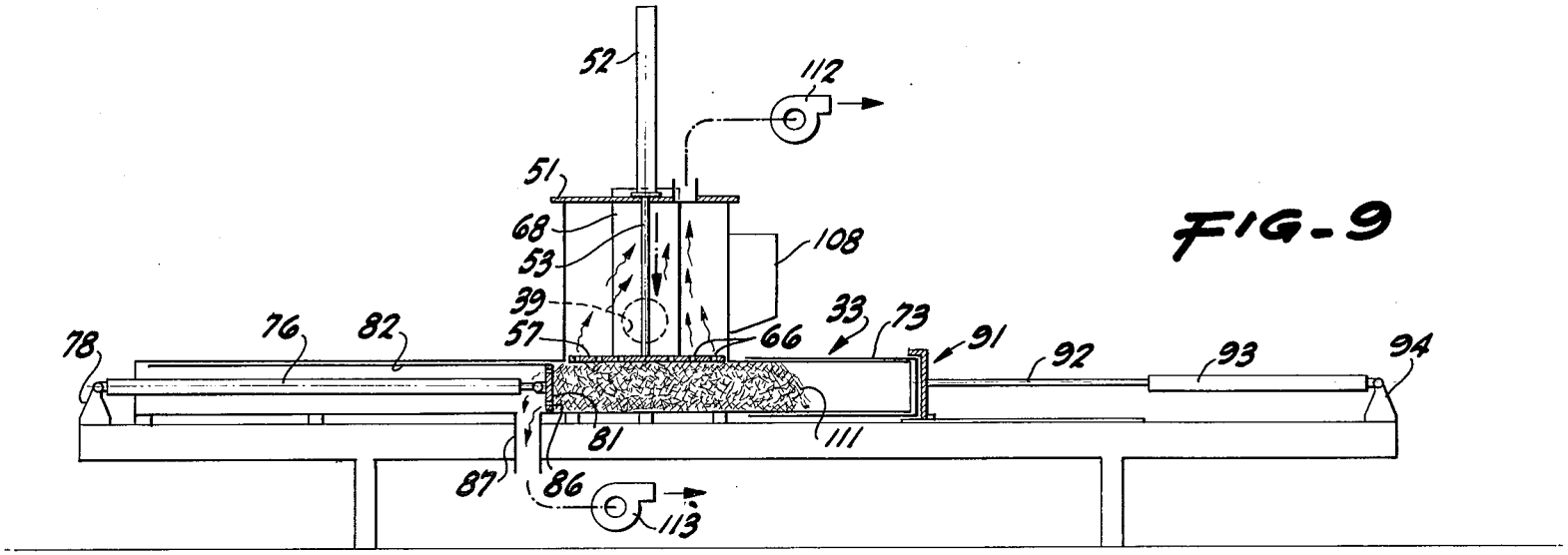

Following the feeding of a desired or predetermined amount of material 111 into the press, there is commenced a sequence of operations to fill the bag 73. A determination as to the amount of material fed into the press may be made merely by viewing the interior of the vertical chamber 32 as through a window 114, for example, or alternatively a level sensor may be mounted within the vertical chamber 32 to conduct a stop signal to the feed screw when the level of material 111 reaches the sensor. Referring now to the FIG. 9 of the drawings, it will be seen that following the feeding of an appropriate amount of material 111 into the press, the feed screw 37 is stopped and the vertical hydraulic cylinder is actuated to force the piston rod 53 thereof downwardly, so that the vertically moveable ram or pressure plate 57 passes down within the chamber 32 to compress the material 111 into the horizontal chamber 33. As the vertical ram 57 moves downwardly, the plate 68 is carried therewith to thus close the feed opening 39. As the material 111 is compressed by the vertically moving ram 57, air will be forced through the perforation 66 of ram 57 and this air, together with particles or dust entrained therein, will be exhausted by the pump 112. This prevents dust or the like from being ejected into the atmosphere about the press. The vertical ram 57 moves downwardly into alignment with the upper wall of the horizontal chamber from the vertical chamber, as shown in FIG. 9. It is also noted that during this compression of the material 111, some air therein will be forced through the perforations 86 of the horizontal ram 81 to thus be exhausted by the pump 113.

Figure 10:
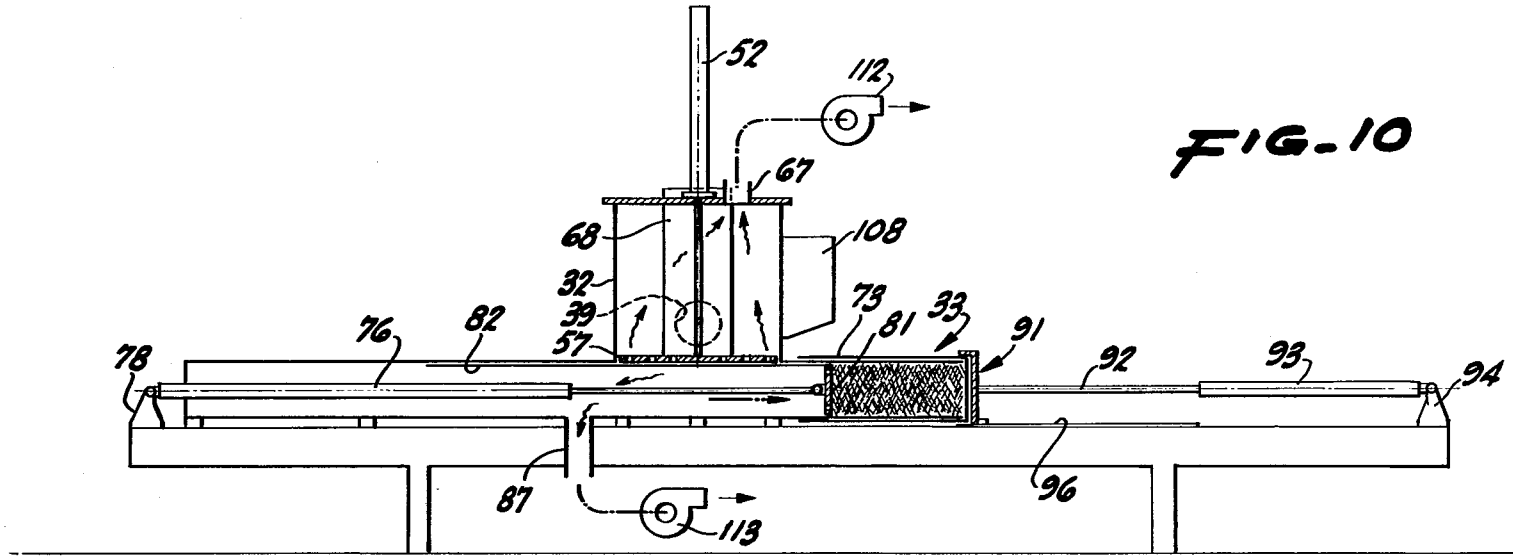

Upon compression of the material 111 entirely into the chamber 33, the horizontal ram is actuated by energizing the cylinder 76 so that the piston rod 77 thereof is driven to the right in FIG. 10 to thereby force the ram 81 to compress the material 111 into the compression chamber 72. The horizontal ram 81 is driven to a position substantially as illustrated in FIG. 10 wherein the ram is disposed within the bag 73 fitted over the open end of the extension 72 and, of course, it will be appreciated that the back-up plate 91 remains in close engagement with the open end of the cylinder extension, in order to seal the end of the bag thereat and provide a backing against which the material may be compressed. It is noted that as the horizontal ram 81 is driven to the right in FIG. 10, the shutter 82 is moved across the opening between the vertical chamber 32 and the horizontal chamber 33, so as to terminate the communication between these volumes. During the further compression of the material by the horizontal ram, the remaining air entrained in material 111 is forced through the holes 86 in the horizontal ram and exhausted by the pumps 112 and 113. Once the shutter 82 has closed off the vertical chamber 32, the ram 57 may be raised by the return of the hydraulic cylinder 52. The position of the press illustrated in FIG. 10 illustrates the material 111 in maximum compression within the compression chamber 72 about which the bag 73 is disposed.

Figure 11:
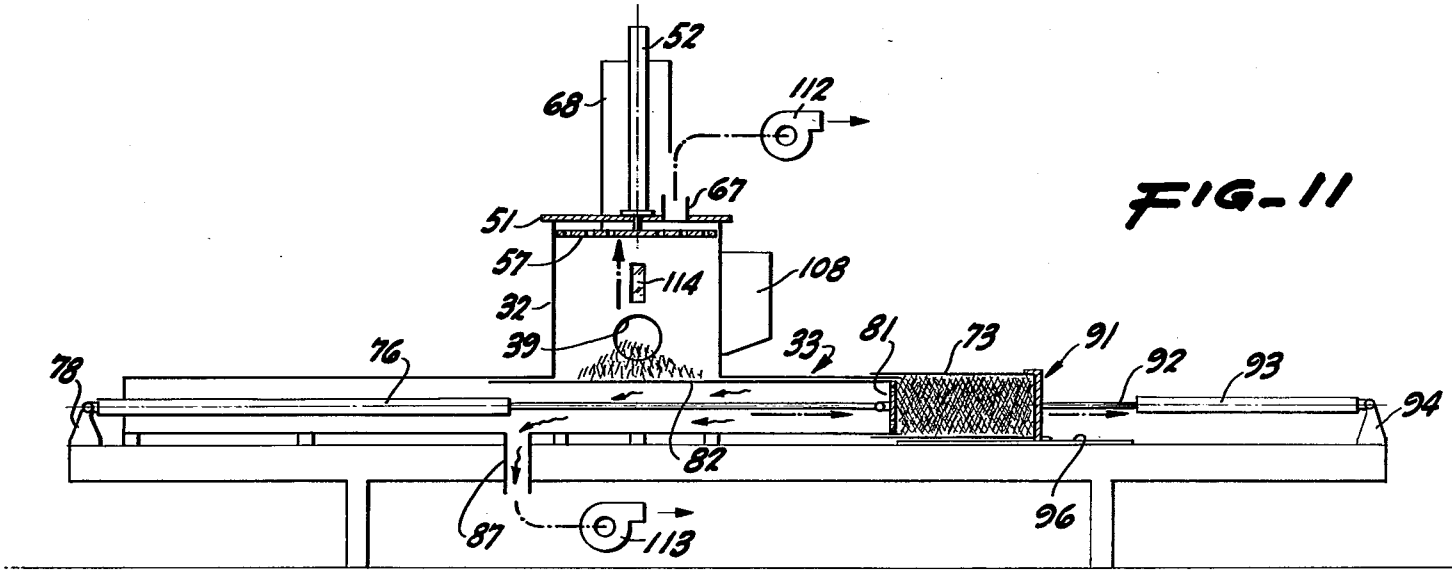

As the material 111 is being compressed in the compression chamber 72 by the horizontal ram 81, the vertical ram 57 is withdrawn upwardly into the position, as illustrated in FIG. 11, whereat the plate 68 uncovers the feed opening. The feed screw is then activated to feed material into the vertical chamber 32 which has the shutter 82 closing the bottom thereof. During the feeding of material into the chamber 32 near the bottom thereof, the material compresses somewhat so that some air is removed from the material.

In order to remove a bag 73 that has been filled with compressed material 111, the cylinder 93 is operated to move the back-up plate 91 to the right, while the cylinder 76 continues to urge the ram 81 to the right. As a consequence of the foregoing, the bag 73 is slid of off the exterior of the cylindrical extension 72 into the position illustrated in FIG. 11. In actuality, the horizontal ram 81 is moved at the same or slightly lesser velocity than the velocity of the back-up plate 91 during this operation, in order that the material within the bag will not be further compressed to possibly bulge the bag. It is noted that in this respect that the bag 73 may be formed, for example, of craft paper or the like having a fairly substantial strength, in order to retain the compressed material 111 therein. A filled bag is removed from the press by operating the cylinder 76 to withdraw the piston rod and attached horizontal ram 81 to the left in FIGS. 8 through 11. In this condition, the bag 73 may readily be removed from the bed plate 96 of the frame upon which the bag then rests. Another bag 73 is then slipped over the outside walls of the compressed chamber 72 with the bottom of the bag fitting about the open end and the back-up plate 91 is moved into forcible engagement with the bottom of the bag by cylinder 93. Upon completion of this replacement of an empty bag on the press, the horizontal ram 81 is moved further to the left in FIG. 11 to thus remove the shutter 82 from closing off the communication between the vertical chamber 32 and the horizontal chamber 33. The material 111 previously fed into the chamber 32 and falls into the chamber 33 and with the horizontal ram 81 fully retracted, as shown in FIG. 8, material is continually fed into the chamber 32 until an appropriate amount of material is disposed therein and the sequence described above is repeated.

It will be appreciated that the filled bags 73 have the tops closed and sealed in conventional manner so as to provide full containers for shipping or storage of material in the bags. In practice, the feed screw 37 is normally stopped and started in accordance with the above-described sequence of operations of the press, however, the feed screw may be continuously rotated and, during the time the opening 39 and the chamber 32 is closed by the plate 68, the feed screw will merely rotate material in the exterior chamber 32. By providing the shutter 82 as a portion of the horizontal ram, it is possible to commence filling the chamber 32 while other operations of the press are continuing so that the overall speed of bag filling is maximized. The exhaust fans or pumps 112 and 113 may be continuously operated so as to always draw air and entrained dust or the like out of the press.

It will be noted that the present invention provides a relatively simply physical structure requiring only three hydraulic or possible pneumatic cylinders. Control over the operations and sequencing of operations of the cylinders 52, 76, and 93 may be quite simply accomplished as by the control means 108, having, for example, a motor driven cam for operating hydraulic valves connecting a source of high pressure fluid to the cylinders 52, 76 and 93. Hydraulic and pneumatic control valves are well known in the art and various manners of timed and sequenced actuation thereof are widely employed, so that no further details of the control means 108 are included herein. It is, however, noted that the particular sequence of operations set forth above is to be followed in order to maximize the efficiency of operations of the press in the present invention. For ready reference, there is set forth below, a Table of sequential operations accomplished by the three hydraulic cylinders under command of the control means.

SEQUENCE OF OPERATIONS

| | Vertical Ram 57 | Horizontal Ram 81 | Back-up Plate |
|---|---|---|---|
| 1. | Raised | Retracted | Extended (with bag in press) |
| 2. | Start to lower | Retracted | Extended |
| 3. | Stop in lower position | Start to extend | Extended |
| 4. | Start to raise | Extended into bag and still moving | Start to retract |
| 5. | Raised | Stop fully extended | Stop retracted |
| 6. | Raised | Retract from bag (Remove filled bag and insert empty) | Retracted |
| 7. | Raised | Retract to chamber | Move to extended |
| 8. | Raised | Retracted START OVER | Extended |

The present invention has been described above with respect to a preferred embodiment thereof, however, it will be apparent to those skilled in the art that numerous modifications and variations may be made within the spirit and scope of the present invention and thus it is not intended to limit the invention to the precise terms of description or details of illustration.

What is claimed is:

1. A hydraulic bagging press comprising a vertical hydraulic cylinder having a perforated ram slidably engaging walls of a vertical chamber for compressing material disposed therein, screw feed means feeding divided material into said vertical chamber below said ram therein, a horizontal hydraulic cylinder having a perforated horizontal ram slidably engaging the walls of an open-ended chamber disposed across the bottom of said vertical chamber and communicating therewith whereby said vertical ram compresses material into said horizontal chamber, a hydraulic operated back-up plate mounted for controlled movement toward and away from the open end of said horizontal chamber for controllably holding a bag about the open end thereof, said horizontal ram being moveable to compress said material into the open end of said horizontal chamber against a bag end held thereat by said back-up plate and further moveable with said back-up plate to remove a bag with compressed material therein, and exhaust means communicating with each of said rams on the sides thereof toward the respective cylinders for withdrawing air and entrained particles of said material from said press.

2. The bagging press of claim 1 further defined by an exterior chamber for receiving divided material to be bagged and having said feed screw rotatably mounted at the bottom thereof for feeding material through a feed opening in a wall of said vertical chamber, and said vertical ram having a vertical plate attached thereto for movement therewith to close said feed opening in said vertical chamber as said vertical ram is moved downward in said vertical chamber.

3. The bagging press of claim 1 further defined by said horizontal ram having a shutter plate attached thereto for movement therewith to close the communication between said vertical and horizontal chambers as said horizontal ram is moved toward the open end of said horizontal chamber.

4. The bagging press of claim 1 further defined by said back-up plate comprising a flat plate mounted upon the piston rod of a third hydraulic cylinder and slidably disposed upon an elongated bed plate aligned with the open end of said horizontal chamber for controlled movement along said bed plate and have a resilient member attached thereto on the side of the plate toward the open end of the said horizontal chamber with resilient side walls extending toward said open end as a guard.

5. The bagging press of claim 1 further defined by an elongated horizontal frame mounting said horizontal hydraulic cylinder and open-ended horizontal chamber longitudinally of said frame with the open end thereof cantilevered over the frame to receive a bag in sliding relation thereover and in closing relation to said open-ended chamber, said vertical chamber being mounted atop said horizontal chamber with an opening in the top wall of said horizontal chamber providing said communication with said vertical chamber, and adjustable means limiting the maximum movement of said vertical ram in said vertical chamber to a position closing the communicating opening in the top wall of said horizontal chamber.

6. The bagging press of claim 5 further defined by a flat bed plate disposed atop said frame in extension from the open end of said horizontal chamber and having said back-up plate slidably disposed thereon for controlled movement longitudinally thereof, and said back-up plate having a resilient member attached thereto facing said open-ended chamber with side walls disposed to push away a hand or the like that may be disposed between said back-up plate and open end of said horizontal chamber during movement of said back-up plate.

7. The bagging press of claim 1 further defined by said vertical chamber having a rectangular interior cross section slidably engaged by said vertical ram and having an open bottom communicating with said horizontal chamber, and said horizontal chamber having a rectangular interior cross section with the same width as the width of said vertical chamber whereby the front and back walls of said vertical chamber are aligned with the side walls of said horizontal chamber at the opening therebetween, and said vertical ram being moveable downward in said vertical chamber into extended position aligned with the top wall of said horizontal chamber for closing off the opening between said vertical and horizontal chambers prior to movement of said horizontal ram toward the open end of said horizontal chamber.

8. The bagging press of claim 7 further defined by said horizontal ram having a shutter plate attached thereto for sliding engagement with the top wall of said horizontal chamber with movement of said horizontal ram for closing the opening between said vertical and horizontal chambers as said horizontal ram moves along said horizontal chamber, and means retracting said vertical ram from said extended position upon closure of said opening between said vertical and horizontal chambers by said shutter plate.

* * * * *